US007620342B2

(12) United States Patent
Sata

(10) Patent No.: US 7,620,342 B2
(45) Date of Patent: Nov. 17, 2009

(54) IMAGE FORMING APPARATUS HAVING PLURAL AIR FLOW PATHS

(75) Inventor: Hidefumi Sata, Koganei (JP)

(73) Assignee: Konica Minolta Business Machines Technologies, Inc., Tokyo (JP)

( * ) Notice: Subject to any disclaimer, the term of this patent is extended or adjusted under 35 U.S.C. 154(b) by 0 days.

(21) Appl. No.: 12/015,330

(22) Filed: Jan. 16, 2008

(65) Prior Publication Data

US 2009/0052933 A1 Feb. 26, 2009

(30) Foreign Application Priority Data

Aug. 20, 2007 (JP) ..... 2007-213456

(51) Int. Cl.
*G03G 21/20* (2006.01)

(52) U.S. Cl. ..... 399/92

(58) Field of Classification Search ..... 399/92, 399/91

See application file for complete search history.

(56) References Cited

U.S. PATENT DOCUMENTS 5,471,280 A * 11/1995 Taguchi ..... 399/330
6,266,498 B1 7/2001 Oda et al.
6,308,024 B1 10/2001 Nakayama et al.
7,512,355 B2 * 3/2009 Fujii et al. ..... 399/92
2005/0074254 A1 * 4/2005 Maeda ..... 399/92

FOREIGN PATENT DOCUMENTS

JP 59220773 A * 12/1984
JP 10-115958 5/1998
JP 10207309 A * 8/1998
JP 2003295713 A * 10/2003
JP 2005 017939 A 1/2005

OTHER PUBLICATIONS

Extended European Search Report Issed by the EPO.

* cited by examiner

*Primary Examiner*—Quana M Grainger
(74) *Attorney, Agent, or Firm*—Finnegan, Henderson, Farabow, Garrett & Dunner, L.L.P.

(57) ABSTRACT

An image forming apparatus for forming an image including: a photoreceptor; a charging apparatus for charging the photoreceptor; and exposure apparatus for exposing an image onto the charged photoreceptor and forming an electrostatic latent image on the photoreceptor; a development apparatus for developing the electrostatic latent image on the photoreceptor; and a plural kinds of air flow paths for discharging air out of the apparatus by ventilating the air in an axial direction of the photoreceptor; wherein air flow directions in the plural kinds of air flow paths are made to be one and the same direction.

6 Claims, 5 Drawing Sheets

IMAGE FORMING APPARATUS HAVING PLURAL AIR FLOW PATHS

CROSS REFERENCE TO RELATED APPLICATION

The present application is based on Japanese Patent Application No. 2007-213456 filed with Japanese Patent Office on Aug. 20, 2007, the entire content of which is hereby incorporated by reference.

BACKGROUND OF THE INVENTION

1. Field of the Invention

The present invention relates to an image forming apparatus for forming an image on a sheet by an electrophotographic process, particularly to an image forming apparatus incorporating a plurality of air flow paths.

2. Description of the Related Art

The image forming apparatus based on electrophotographic process is provided with a passage for guiding the cooling air for cooling a fixing apparatus and development apparatus, the air including the ozone generated in a charging apparatus, and the air containing scattered toner, to ensure that the air, processed with dust protection and ozone elimination measures, is discharged out of the image forming apparatus.

Means are devised to ensure that cooling and ozone elimination steps can be taken effectively even when the apparatus is designed in a compact configuration and various forms of components inside the apparatus are packed in compact arrangements.

For example, the Japanese Unexamined Patent Application Publication No. 10-115958 (JPA10-115958) discloses an image forming apparatus wherein a ventilation duct is installed between the cleaning apparatus and fixing apparatus and an outer air intake fan is arranged in the vicinity of the charging apparatus. The incoming air is led in the axial direction of the aforementioned photoreceptor inwardly (one way only), and is then led in the axial direction of the aforementioned photoreceptor inside the aforementioned ventilation duct outwardly to be discharged out of the image forming apparatus.

In the image forming apparatus of JPA10-115958, the direction of air flowing in the vicinity of the charging apparatus is opposite that of the air flowing through the ventilation duct between the cleaning apparatus and fixing apparatus.

Such an airflow path cannot be said to be a rational and effective flow path in an image forming apparatus of compact configuration.

To be more specific, air flows through the image forming apparatus in two opposite directions. If two air paths are arranged close to each other in a compact version, two streams of air flowing in opposite directions will interfere with each other. Thus, one air stream will hinder the other air stream, with the result that the effects of cooling, ozone elimination and scattered toner recovery may be reduced.

To solve this problem, the air flow paths must be separated from each other. This will make it difficult to design a compact apparatus.

Several types of air flow paths arranged around the development apparatus in particular are close to one another, and there will be serious interference among flow paths.

The object of the present invention is to solve such a problem and to provide an image forming apparatus of compact design wherein sufficient ozone elimination, recovery of scattered toner and cooling of development apparatus are ensured.

SUMMARY

The aforementioned object can be achieved by the following image forming apparatus reflecting one aspect of the present invention:

An image forming apparatus for forming an image, including:

a photoreceptor;

a charging apparatus for charging the photoreceptor;

an exposure apparatus for exposing an image onto the charged photoreceptor and forming an electrostatic latent image on the photoreceptor;

a development apparatus for developing the electrostatic latent image on the photoreceptor; and a plural kinds of air flow paths for discharging air out of the apparatus by ventilating the air in an axial direction of the photoreceptor;

wherein air flow directions in the plural kinds of air flow paths are made to be one and the same direction.

BRIEF DESCRIPTION OF THE DRAWINGS

These and other objects, advantages and features of the invention will become apparent from the following description thereof taken in conjunction with the accompanying drawings in which.

DETAILED DESCRIPTION OF THE PREFERRED EMBODIMENTS

The following describes the present invention with reference to the embodiment of the present invention, without the present invention being restricted thereto.

Figure 1:
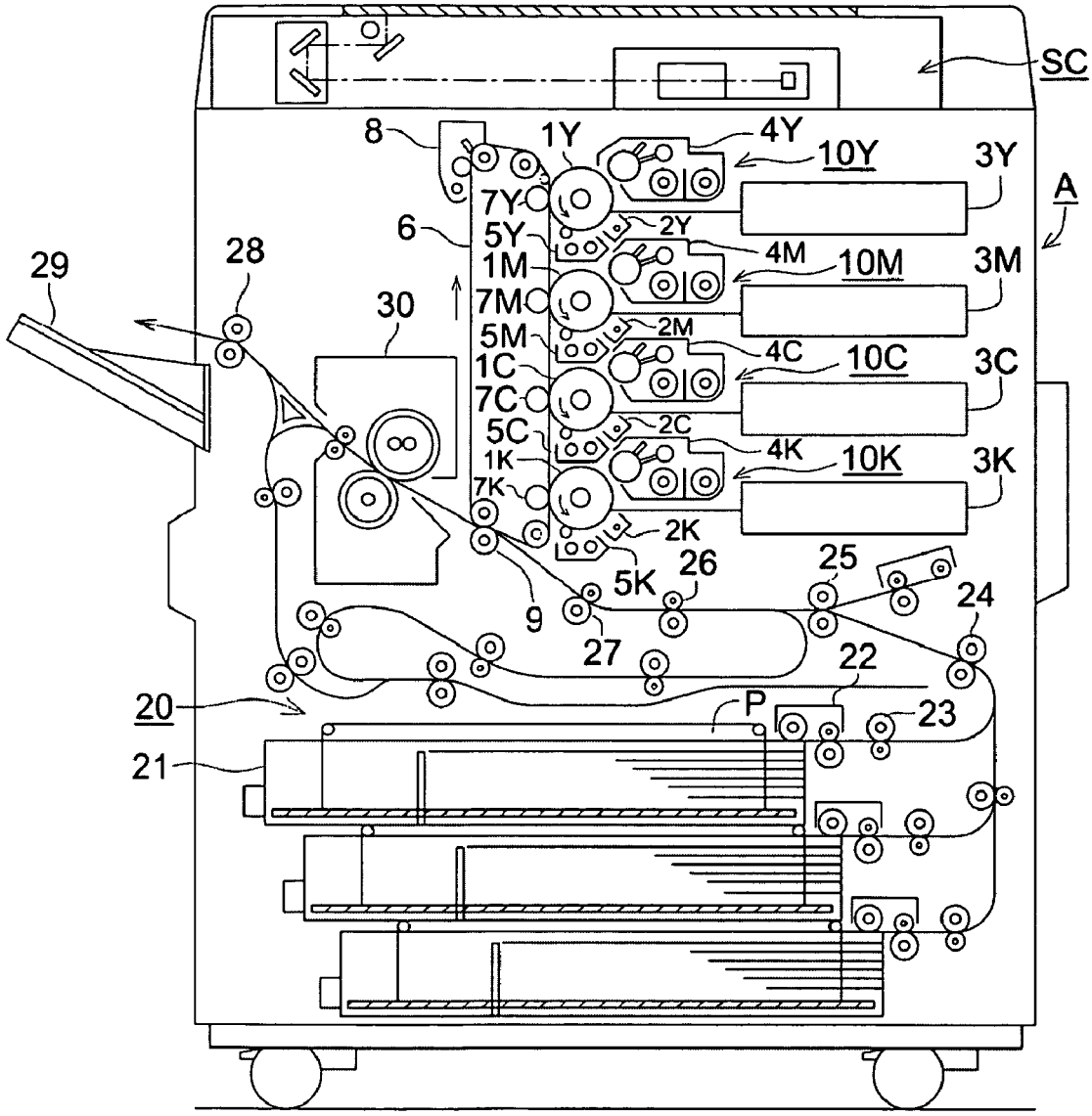
FIG. 1 is a drawing representing the overall structure of the image forming apparatus A as an embodiment of the present invention.

FIG. 1 is a drawing representing the overall structure of the image forming apparatus A as an embodiment of the present invention.

The image forming apparatus A is what is called the tandem type color image forming apparatus, and includes a plurality of image forming units 10Y, 10M, 10C and 10K, a belt-like intermediate transfer member 6, a sheet feed apparatus 20 and a fixing apparatus 30.

An image reading apparatus SC is mounted on the top of the image forming apparatus A. The originals placed on the original platen are exposed and scanned by the optical system of the original image scanning exposure apparatus of the image reading apparatus SC and the image of the original is read by the line image sensor.

The analog signal obtained by photoelectric conversion by the line image sensor is subjected to such processing as analog processing, analog-to-digital conversion, shading correction and image compression by the image processing section. After that, the signal is inputted into the exposure apparatuses 3Y, 3M, 3C, 3K.

The image forming unit 10Y for forming a yellow (Y) toner image includes a charging apparatus 2Y, an exposure apparatus 3Y, a development apparatus 4Y and a cleaning apparatus 5Y which are arranged around the photoreceptor 1Y.

The image forming unit 10M for forming a magenta (M) toner image includes a charging apparatus 2M, an exposure apparatus 3M, a development apparatus 4M and a cleaning apparatus 5M.

The image forming unit 10C for forming a cyan (C) toner image includes a charging apparatus 2C, an exposure apparatus 3C, a development apparatus 4C and a cleaning apparatus SC.

The image forming unit 10K for forming a black (K) toner image includes a charging apparatus 2K, an exposure apparatus 3K, a development apparatus 4K and a cleaning apparatus 5K.

The 4Y, 4M, 4C and 4K are development apparatuses that accommodate two-component developer containing yellow (Y), magenta (M), cyan (C) and black (K) toners having a small particle diameter, and carriers.

An intermediate transfer member 6 is wound with a plurality of rollers, and is rotatably supported.

Toner images of various colors formed by image forming units 10Y, 10M, 10C and 10K are sequentially primarily-transferred onto the rotating intermediate transfer member 6 by the primary transfer apparatuses 7Y, 7M, 7C and 7K, and are formed into a superimposed color toner image.

Paper P stored in the sheet feed cassette 21 of the sheet feed apparatus 20 is fed by a sheet feed section 22, and is conveyed to a secondary transfer apparatus 9 through the sheet feed rollers 23, 24, 25 and 26, registration roller 27. Then the color toner image is secondarily transferred onto the paper P.

The three-step sheet feed cassettes 21 arranged in a single file in the vertical direction below the image forming apparatus A have almost the same structure. The three-step sheet feed sections 22 also have almost the same structure. Including the sheet feed cassette 21 and sheet feed section 22, this is called the sheet feed apparatus 20.

The paper P with the color toner image transferred thereon is subjected to a step of fixing by heat and pressure in the fixing apparatus 30. The upper surface of the paper P subsequent to fixing is sandwiched by ejection rollers 28, and the paper is placed on the ejection tray 29 outside the apparatus.

In the meantime, after the color toner image has been transferred onto the paper P by the secondary transfer apparatus 9, the intermediate transfer member 6 is cleaned by a cleaning apparatus 8 so that the residual toner is removed.

The image forming apparatus A is a color image forming apparatus, and the present invention can also be applied to the image forming apparatus for forming a monochromatic image.

In the following description, the photoreceptors 1Y, 1M, 1C and 1K will be collectively called the photoreceptor 1, and the development apparatuses 4Y, 4M, 4C and 4K will be collectively called the development apparatus 4.

Figure 2:
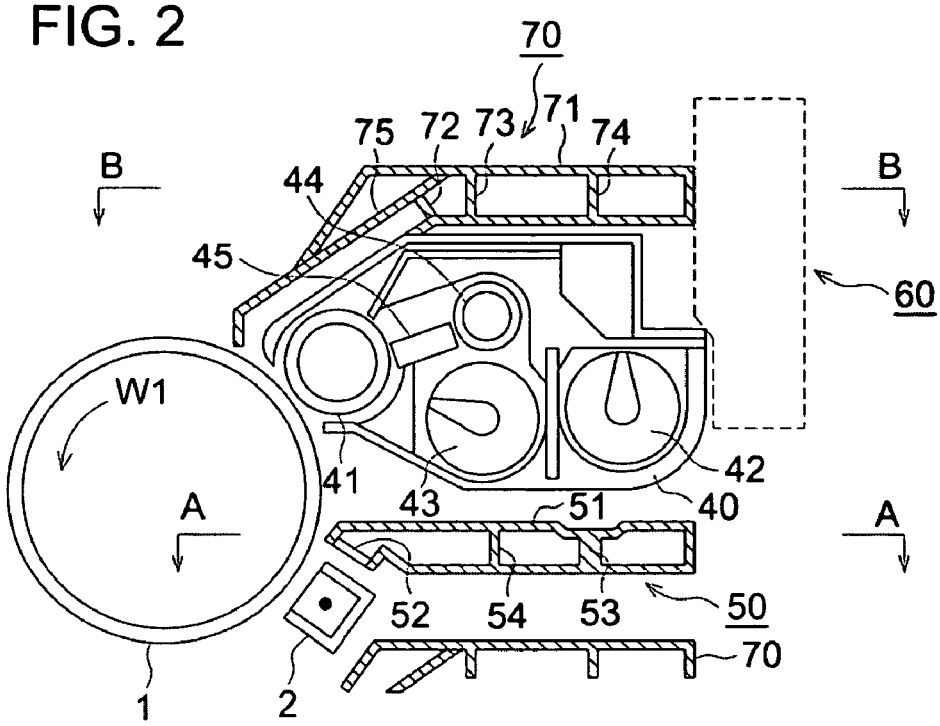
FIG. 2 is a cross sectional view representing the front surface of the image forming apparatus A, wherein the structure in the vicinity of a development apparatus is shown.

FIG. 2 is a cross sectional view representing the front surface of the image forming apparatus A, wherein the structure in the vicinity of a development apparatus is shown.

The structure in the vicinity of the development apparatuses 4Y, 4M, 4C and 4K is as shown in FIG. 2. A plurality of air flow paths are arranged around the development apparatus. A plurality of air flow paths include an ozone passage as a passage of the air including ozone, a scattered toner passage as a passage of the air including scattered toner, and a cooling air passage allowing passage of cooling air. As "4" is used to denote the development apparatuses 4Y, 4M, 4C and 4K, the abbreviated symbol of omitting YMCK will be assigned to each part in the following description.

The development apparatus 4 incorporates a housing 40, which further includes a development roller 41, agitation/conveyance screws 42 and 43, a regulating member 43 for regulating developer, and a developer recovery roller 44.

The development roller 41 is configured with a rotating development sleeve and a magnetic roll arranged and fixed in the rotating development sleeve, the magnetic roll containing a plurality of magnetic poles. The recovery roller 44 is configured with a rotating recovery sleeve and a magnetic roll, which contains a plurality of magnetic poles, arranged and fixed in the rotating recovery sleeve.

In the step of image formation, the photoreceptor 1 rotates in the counterclockwise direction as indicated by the arrow mark W1, and the electrostatic latent image on the photoreceptor 1 is developed by the layer of developer on the development roller 41.

In the development apparatus 4, the agitation/conveyance screws 42 and 43 rotate to agitate and convey the developer so that the developer is supplied onto the development roller 41.

The developer on the development roller 41 is regulated by the regulating member 45 so that a fixed amount of developer is always supplied to the development area.

After development, the developer is fed below the development roller 41 and is recovered by the agitation/conveyance screw 43. Further, the excess developer regulated by the regulating member 45 is recovered by the recovery roller 44, and is fed to the agitation/conveyance roller 42.

A charging apparatus 2 is arranged below the development apparatus 4. The ozone having been generated in the charging apparatus 2 passes through the ozone passage 50 arranged below the development apparatus 4.

The ozone passage 50 is made of a duct 51 including a gas inlet 52, and consists of the passage divided into a plurality of parts as shown in FIG. 2 by the partition members 53 through 55 for regulating air flow.

Figure 3:
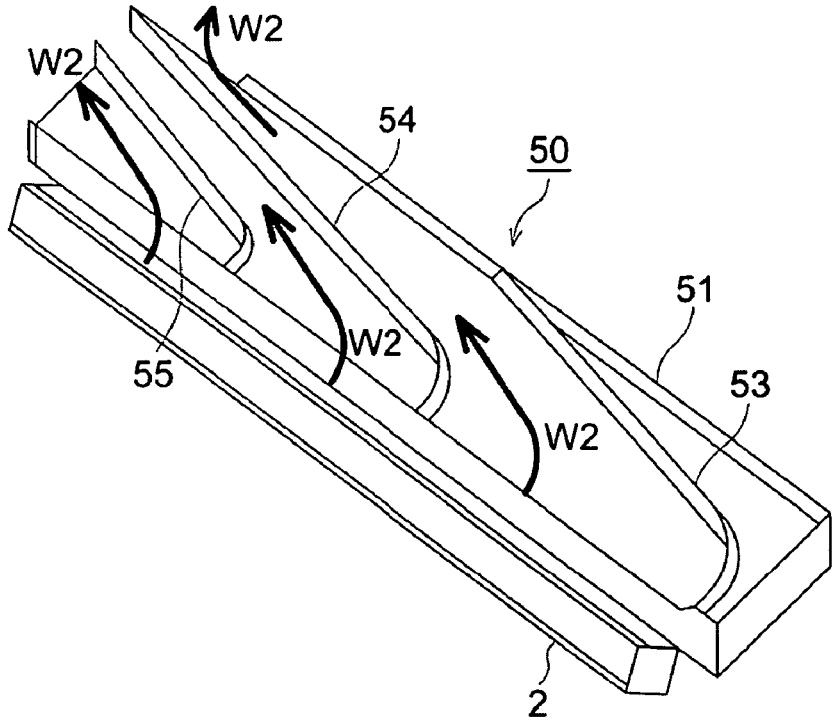
FIG. 3 is a perspective view taken along arrow line A-A of FIG. 2.

FIG. 3 is a perspective view taken along arrow line A-A of FIG. 2. As shown in FIG. 3, the ozone passage 50 is divided into a plurality of parts by the partition members 53 through 55.

As indicated by the arrow mark W2, air containing ozone passes through the ozone passage 50. As will be described later, ozone is removed, and the air is discharged out of the image forming apparatus A (FIG. 1).

A cooling air passage 60 is formed on the side of the development apparatus 40.

The cooling air passage 60 is formed by the space surrounded by a plurality of parts constituting the image forming apparatus A.

A scattered toner passage 70 is formed above the development apparatus 4.

Figure 4:
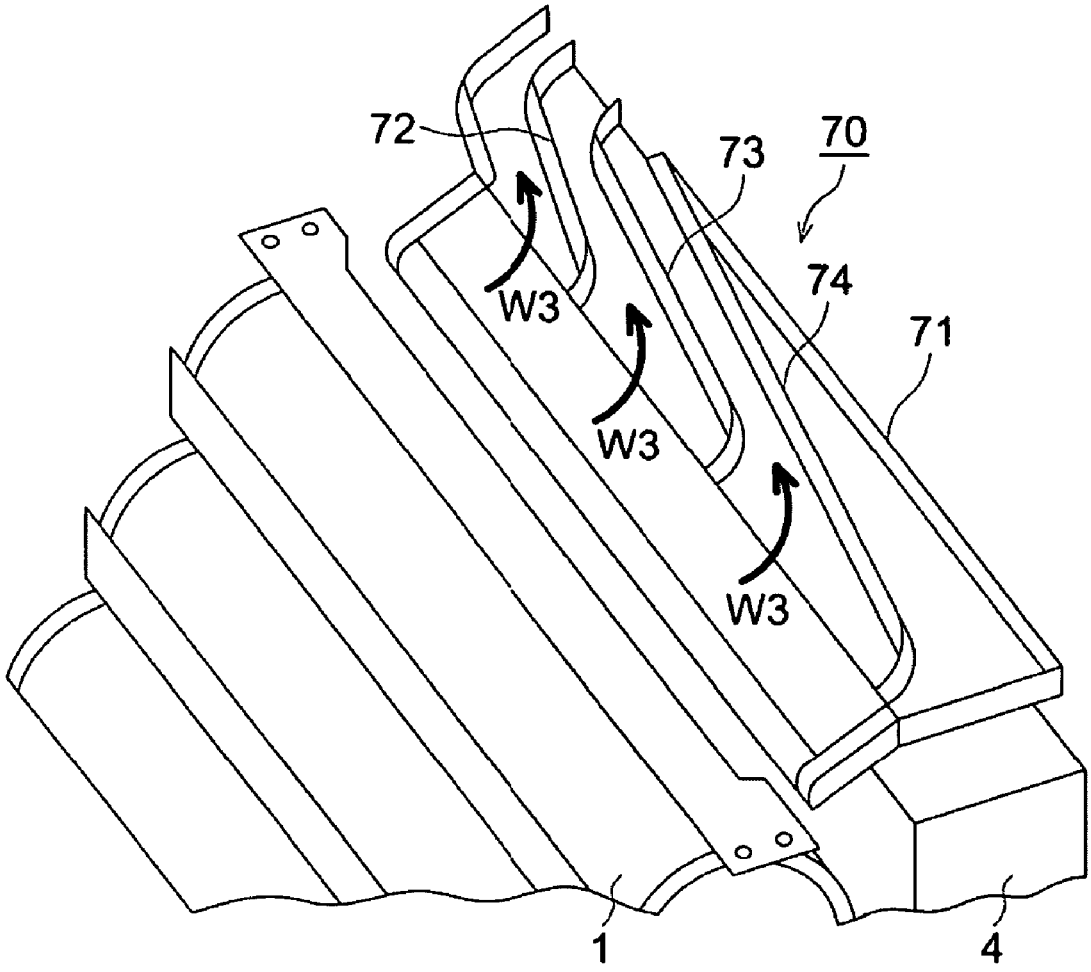
FIG. 4 is a perspective view taken along arrow line B-B of FIG. 2.

The scattered toner passage 70 is made up of a duct 71. As shown in FIG. 4, the scattered toner passage 70 is divided into a plurality of parts by the partition members 72 through 74. The air containing toner passes through each passage flows as indicated by the arrow mark W3. As will be described later, the air is discharged out of the image forming apparatus A. FIG. 4 is a perspective view taken along arrow line B-B of FIG. 2.

The recovery passage for recovering toner into the scattered toner passage 70 is made up of the housing 40 of the development apparatus and the cover member 75 connected to the duct 71.

Figure 5:
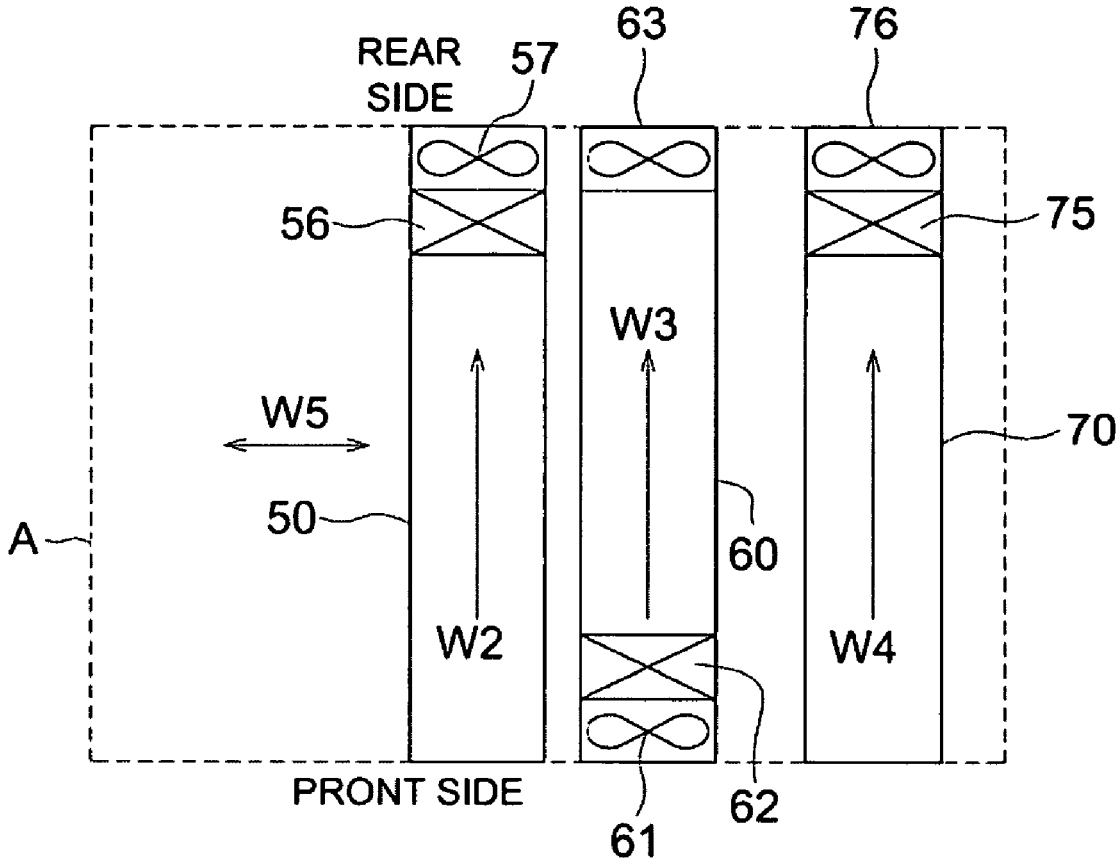
FIG. 5 is a diagram representing the air flow path of the image forming apparatus.

FIG. 5 shows the air flow path of the image forming apparatus.

The ozone filter 56 and exhaust fan 57 are mounted on the exhaust section of the ozone passage 50. The ozone generated in the charging apparatus 2 is sucked by the exhaust fan 57, and the air from which ozone has been removed by the ozone filter 56 is discharged out of the image forming apparatus A.

The air supply fan 61 and filter 62 are installed on the outside air inlet section of the cooling air passage 60, and the exhaust fan 63 is arranged on the exhaust section.

The dust protection filter 75 and exhaust fan 76 are mounted on the exhaust section of the scattered toner passage 70. Toner is sucked by the exhaust fan 76, and the air from which toner has been removed by the dust protection filter 75 is discharged out of the image forming apparatus A.

The exhaust fans 57, 63 and 76 can be configured with one or two common fans.

In FIG. 5, the lower portion indicates the front side of the image forming apparatus A, while the upper portion represents the rear side of the image forming apparatus A.

The air flow direction W2 in the ozone passage 50, the air flow direction W3 in the cooling air passage 60, and the air flow direction W4 in the scattered toner passage 70 respectively have traveling components in axial direction of the photoreceptor, namely in perpendicular direction to the moving direction of the photoreceptor, which being parallel to the surface of the photoreceptor.

The direction W2, direction W3 and direction W4 are arranged in the same orientation with one another. The symbol W5 denotes the traveling direction of the photoreceptor.

Even in an apparatus wherein passages 50, 60 and 70 are arranged close to one another, according to the above direction of air flow, a smooth flow of air in each passages is ensured without the air flow in each passage interfering with that in the other passage, thereby ensuring an effective removal of ozone, cooling of the development apparatus and recovery of scattered toner.

That air flow directions W2 through W4 are arranged in the same orientation is not restricted to mean that there must be complete agreement among directions W2 through W4. For example, this includes the case wherein the air flows in the direction oblique to the axial direction of the aforementioned photoreceptor as induced by the partition members 53 through 55, and 72 through 74 shown in FIG. 3 and FIG. 4.

Figure 6:
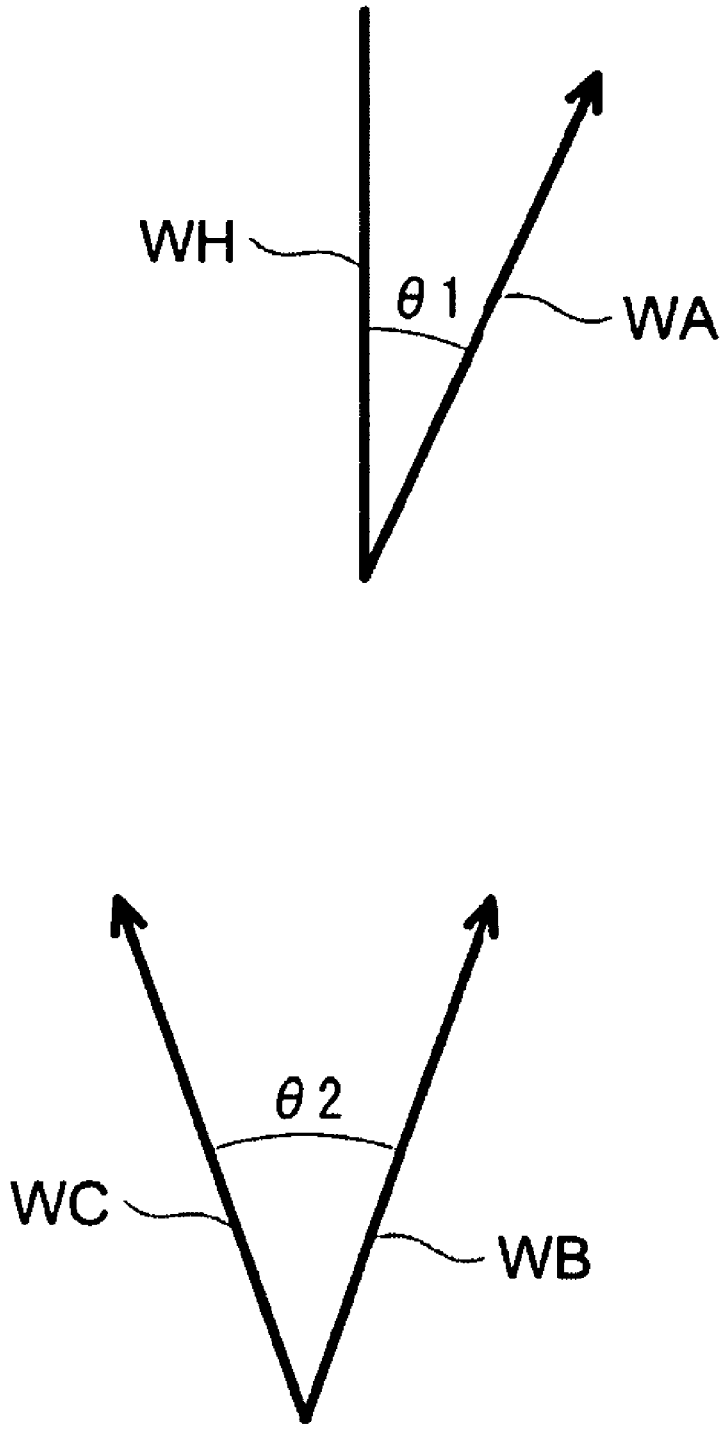
FIG. 6 is a diagram representing that air flows in one and the same direction.

Referring to FIG. 6, the following describes "flow of air in the axial direction of the photoreceptor" and "two air flows in the same direction".

When the angle θ1 between the air flow direction WA and axial direction WH of the photoreceptor is less than 45 degrees, air is assumed to flow in the axial direction of the aforementioned photoreceptor.

When the angle θ2 between the arrow mark WB and arrow mark WC is less than 90 degrees, the air flow direction indicated by the arrow mark WB is assumed as the same as that indicated by the arrow mark WC.

When the nip angle θ2 is greater than 90, the air flow indicated by the arrow mark WB interferes with the air flow indicated by the arrow mark WC. If the nip angle θ is less than 90, however, there is no interference.

In the present invention, the direction of air flow in a plurality of air flow paths is the same as the axial direction of the photoreceptor. This arrangement ensures an effective removal of ozone, cooling of the development apparatus and removal of scattered toner without any interference among air flows in each flow path, whereby a compact design of the apparatus can be achieved.

What is claimed is:

1. An image forming apparatus for forming an image comprising:

a photoreceptor which rotates around an axis of rotation;

a charging apparatus for charging the photoreceptor;

an exposure apparatus for exposing an image onto the charged photoreceptor and forming an electrostatic latent image on the photoreceptor;

a development apparatus for developing the electrostatic latent image on the photoreceptor;

a fixing apparatus for fixing an image on a sheet by heat and pressure; and plural kinds of air flow paths, each of which is separately provided for discharging air out of the apparatus by ventilating the air;

wherein the plural kinds of air flow paths comprise at least two paths out of:

an ozone path which flows air containing ozone having been generated during operation of the charging apparatus;

a cooling air path which flows cooling air from outside the apparatus to cool the development apparatus; and a scattered toner path which flows air containing a scattered toner having been generated in the development apparatus and collected, wherein air flow directions of at least the two kinds of air flow paths in the plural kinds of air flow paths are in a same direction range which is within less than 45 degrees from the direction of the axis of rotation of the photoreceptor.

2. The image forming apparatus of claim 1, wherein the plural kinds of air flow paths are arranged around the development apparatus.

3. The image forming apparatus of claim 1, wherein the plural kinds of air flow paths comprise:

an ozone path which flows air containing ozone having been generated during operation of the charging apparatus, wherein the ozone path comprises plural divided ozone paths which are separated from each other, and each of the divided ozone paths has an inlet separated from an inlet of an adjacent other divided ozone path in the axial direction of the photoreceptor; and a cooling air path which flows cooling air to cool the development apparatus, wherein all air flow directions in the divided ozone paths are in the same direction range which is within less than 45 degrees from the direction of the axis of rotation of the photoreceptor.

4. The image forming apparatus of claim 1, wherein the plural kinds of air flow paths comprise:

an ozone path which flows air containing ozone having been generated during operation of the charging apparatus, wherein the ozone path comprises plural divided ozone paths which are separated from each other, and each of the divided ozone paths has an inlet separated from an inlet of an adjacent other divided ozone path in the axial direction of the photoreceptor; and a scattered toner path which flows air containing a scattered toner having been generated in the development apparatus and collected, wherein all air flow directions in the divided ozone paths are in the same direction range which is within less than 45 degrees from the direction of the axis of rotation of the photoreceptor.

5. The image forming apparatus of claim 1, wherein the plural kinds of air flow paths comprise:

a cooling air path which flows cooling air to cool the development apparatus; and a scattered toner path which flows air containing a scattered toner having been generated in the development apparatus and collected, wherein the scattered toner path comprises plural divided scattered toner paths which are separated from each other, and each of the divided scattered toner path has an inlet separated from an inlet of an adjacent other divided scattered toner path in the axial direction of the photoreceptor, wherein all air flow directions in the divided scattered toner paths are in the same direction range which is within less than 45 degrees from the direction of the axis of rotation of the photoreceptor.

6. The image forming apparatus of claim 1, wherein the plural kinds of air flow paths comprise:

an ozone path which flows air containing ozone having been generated during operation of the charging apparatus;

a cooling air path which flows cooling air to cool the development apparatus; and a scattered toner path which flows air containing a scattered toner having been generated in the development apparatus and collected, wherein all air flow directions in the plural kinds of air flow paths are in the same direction range which is within less than 45 degrees from the direction of the axis of rotation of the photoreceptor.

* * * * *